US009765441B2

(12) United States Patent
Sista et al.

(10) Patent No.: US 9,765,441 B2
(45) Date of Patent: Sep. 19, 2017

(54) METHODS OF FORMING BORIDED DOWN-HOLE TOOLS

(71) Applicant: Baker Hughes Incorporated, Houston, TX (US)

(72) Inventors: Vivekanand Sista, The Woodlands, TX (US); James L. Overstreet, Tomball, TX (US); John H. Stevens, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 644 days.

(21) Appl. No.: 14/019,096

(22) Filed: Sep. 5, 2013

(65) Prior Publication Data

US 2015/0060051 A1 Mar. 5, 2015

(51) Int. Cl.

| | |
|---|---|
| ***C25D 3/66*** | (2006.01) |
| ***C25D 11/00*** | (2006.01) |
| ***C25D 11/02*** | (2006.01) |
| ***C25D 9/04*** | (2006.01) |
| ***C25D 5/02*** | (2006.01) |
| ***E21B 17/10*** | (2006.01) |
| *E21B 10/46* | (2006.01) |

(52) U.S. Cl.

CPC ..... *C25D 11/028* (2013.01); *C25D 3/66* (2013.01); *C25D 5/02* (2013.01); *C25D 9/04* (2013.01); *E21B 17/1085* (2013.01); *E21B 10/46* (2013.01)

(58) Field of Classification Search

CPC ..... C23C 22/70; C25D 3/66; C25D 3/665
USPC ..... 205/230; 148/241, 242
See application file for complete search history.

(56) References Cited

U.S. PATENT DOCUMENTS

| | | | | |
|---|---|---|---|---|
| 3,634,145 | A * | 1/1972 | Homan | C25D 3/66 148/242 |
| 3,697,390 | A * | 10/1972 | McCawley et al. | C25D 9/08 205/148 |
| 4,188,242 | A * | 2/1980 | Scales | C21D 1/78 148/217 |
| 4,210,497 | A | 7/1980 | Bennstedt et al. | |
| 4,499,795 | A | 2/1985 | Radtke | |
| 4,664,722 | A * | 5/1987 | Clinkscales | C21D 1/72 148/212 |
| 4,934,467 | A | 6/1990 | Langford | |

(Continued)

FOREIGN PATENT DOCUMENTS

| | | | |
|---|---|---|---|
| RO | 69862 | A2 | 1/1980 |
| SU | 328214 | A | 11/1972 |

OTHER PUBLICATIONS

Greco, A. et al; "Friction and wear behaviour of boron based surface treatment and nano-particle lubricant additives for wind turbine gearbox applications" Wear, 2011, p. 1754-1760.*

(Continued)

*Primary Examiner* — Brian W Cohen
(74) *Attorney, Agent, or Firm* — TraskBritt

(57) ABSTRACT

A method of forming a downhole tool comprises contacting at least one downhole structure comprising at least one metal material with a molten electrolyte comprising anhydrous sodium tetraborate. Electrical current is applied to at least a portion of the at least one downhole structure to form at least one borided downhole structure comprising at least one metal boride material. Other methods of forming a downhole tool, and a downhole tool are also described.

18 Claims, 3 Drawing Sheets

(56) References Cited

U.S. PATENT DOCUMENTS

| | | | | |
|---|---|---|---|---|
| 6,478,887 | B1 * | 11/2002 | Sue | C23C 8/08 148/279 |
| 2010/0018611 | A1 | 1/2010 | Timur et al. | |
| 2010/0133805 | A1 | 6/2010 | Stevens et al. | |
| 2010/0224498 | A1 | 9/2010 | Ürgen et al. | |
| 2011/0073217 | A1 | 3/2011 | Smith et al. | |
| 2011/0132769 | A1 * | 6/2011 | Hurst | C25D 3/56 205/157 |
| 2012/0018141 | A1 * | 1/2012 | John | C23C 30/00 166/68 |
| 2012/0298425 | A1 | 11/2012 | De Maindreville et al. | |
| 2013/0056363 | A1 | 3/2013 | Timur et al. | |

OTHER PUBLICATIONS

Atik et al., The Effects of Conventional Heat Treatment and Boronizing on Abrasive Wear and Corrosion of SAE 1010, SAE 1040, D2 and 304 Steels, Tribology International, vol. 36, (2003), pp. 155-161.

Erdemir et al., Ultra-Fast Boriding for Improved Energy Efficiency and Reduced Emissions in Materials Processing Industries. Final Report, Energy Systems Division, Argonne National Laboratory, (Aug. 2012), 57 pages.

Kahvecioglu et al., Ultra-Fast Boriding of Nickel Aluminide, Thin Solid Films, vol. 520, (2011), pp. 1575-1581.

Kartal et al., The Growth of Single Fe2B Phase on Low Carbon Steel via Phase Homogenization in Electrochemical Bonding, Surface & Coatings Technology, vol. 206, (2011), pp. 2005-2011.

Oliveira et al., Evaluation of Hard Coatings Obtained on AISI D2 Steel by Thermo-Reactive Deposition Treatment, Surface & Coatings Technology, vol. 201, (2006), pp. 1880-1885.

Sen et al., An Approach to Kinetic Study of Borided Steels, Surface & Coatings Technology, vol. 191, (2005), pp. 274-285.

Sista et al., Electrochemical Boriding and Characterization of AISI D2 Tool Steel, Electrochemical Boriding and Characterization of AISI D2 Tool Steel, Thin Solid Films, vol. 520, (2011), pp. 1582-1588.

Sista et al., Evaluation of Electrochemical Boriding of Inconel 600, Surface & Coatings Technology, vol. 215, (2013), pp. 452-459.

International Search Report for International Application No. PCT/US2014/054277 dated Dec. 16, 2014, 3 pages.

International Written Opinion for International Application No. PCT/US2014/054277 dated Dec. 16, 2014, 11 pages.

International Preliminary Report on Patentability for International Application No. PCT/US2014/054277 dated Mar. 8, 2016, 12 pages.

Translated Abstract of Lyakhovich et al "Low Temperature Boronizing", Metallovedenie i Termichskaya Obrabotka Metallov, 1974.

* cited by examiner

METHODS OF FORMING BORIDED DOWN-HOLE TOOLS

TECHNICAL FIELD

Embodiments of the disclosure relate generally to methods of forming borided downhole tools, and to related downhole tools. More particularly, embodiments of the disclosure relate to methods of forming borided downhole tools using electrochemical boronizing and to related downhole tools.

BACKGROUND

Wellbores are formed in subterranean formations for various purposes including, for example, extraction of oil and gas from the subterranean formations and extraction of geothermal heat from the subterranean formations. Wellbores can exhibit extremely aggressive environments. For example, wellbores can exhibit abrasive surfaces, can be filled with corrosive chemicals (e.g., caustic drilling muds; well fluids, such as salt water, crude oil, carbon dioxide, and hydrogen sulfide; etc.), and can exhibit increasing high temperatures and pressures at progressively deeper "downhole" locations.

The extremely aggressive environments of wellbores can rapidly degrade the materials of structures, tools, and assemblies used in various downhole applications (e.g., drilling applications, conditioning applications, logging applications, measurement applications, monitoring applications, exploring applications, etc.). Such degradation limits operational efficiency of these structures, tools and assemblies, and results in undesirable repair and replacement costs. Accordingly, there is a continuing need for downhole structures, tools, and assemblies having material characteristics capable of withstanding such extremely aggressive environments, as well as for methods of forming such downhole structures, tools, and assemblies.

One approach toward forming downhole structures, tools, and assemblies capable of withstanding such extremely aggressive environments of wellbores includes boronizing the downhole structures, tools, and assemblies. Boronizing, also known as "boriding," is a thermal diffusion process wherein boron atoms diffuse into and react with metals to form metal borides exhibiting relatively enhanced properties (e.g., thermal resistance, hardness, toughness, chemical resistance, abrasion resistance, corrosion resistance, reduction in friction coefficient, mechanical strength, etc.) as compared to the metals. Unfortunately, however, conventional methods of forming borided downhole structures, tools, and assemblies can be cost-prohibitive and environmentally unfriendly. For example, conventional methods of forming borided downhole structures, tools, and assemblies can be time consuming (e.g., powder pack boriding, gas boriding, and fluidized bed boriding processes requiring from about 8 hours to about 10 hours of processing time; plasma boriding processes requiring from about 15 hours to about 25 hours of processing time; molten salt boriding processes requiring from about 6 hours to about 8 hours of processing time; etc.), and can utilize and produce toxic chemicals that necessitate the use of separate and costly equipment and processes to mitigate health, safety, and environmental concerns.

It would, therefore, be desirable to have new methods, systems, and apparatuses for forming borided downhole structures, tools, and assemblies that are simple, fast, cost-effective, and environmentally friendly as compared to conventional methods, systems, and apparatuses for forming borided downhole structures, tools, and assemblies. Such methods, systems, and apparatuses may facilitate increased adoption and use of borided structures, tools, and assemblies in downhole applications.

BRIEF SUMMARY

Embodiments described herein include methods of forming borided downhole tools, and related downhole tools. For example, in accordance with one embodiment described herein, a method of forming a borided downhole tool comprises contacting at least a portion of at least one downhole structure comprising at least one metal material with a molten electrolyte comprising anhydrous sodium tetraborate ($Na_2B_4O_7$). Electrical current is applied to the at least a portion of the at least one downhole structure in contact with the molten electrolyte to form at least one borided downhole structure comprising at least one metal boride material.

In additional embodiments, a method of forming a borided downhole tool comprises at least partially inserting at least one downhole structure comprising at least one metal material into a molten sodium borate at a temperature of from about 770° C. to about 1400° C. Electrical current is applied to the at least one downhole structure for a period of time within a range of from about 1 minute to about 5 hours to convert at least a portion of the at least one metal material into at least one metal boride material and form at least one borided downhole structure. The at least one borided downhole structure is secured to at least one other downhole structure.

In yet additional embodiments, a downhole tool comprises at least one borided structure formed by the method comprising contacting at least a portion of at least one structure comprising at least one metal material with a molten electrolyte comprising anhydrous sodium tetraborate, and applying electrical current to the at least a portion of the at least one structure in contact with the molten electrolyte to diffuse boron into the at least one structure and form at least one metal boride material.

BRIEF DESCRIPTION OF THE DRAWINGS

While the specification concludes with claims particularly pointing out and distinctly claiming that which is regarded as the invention, advantages of the invention can be more readily ascertained from the following detailed description when read in conjunction with the accompanying drawings in which:

DETAILED DESCRIPTION

Figure 1:
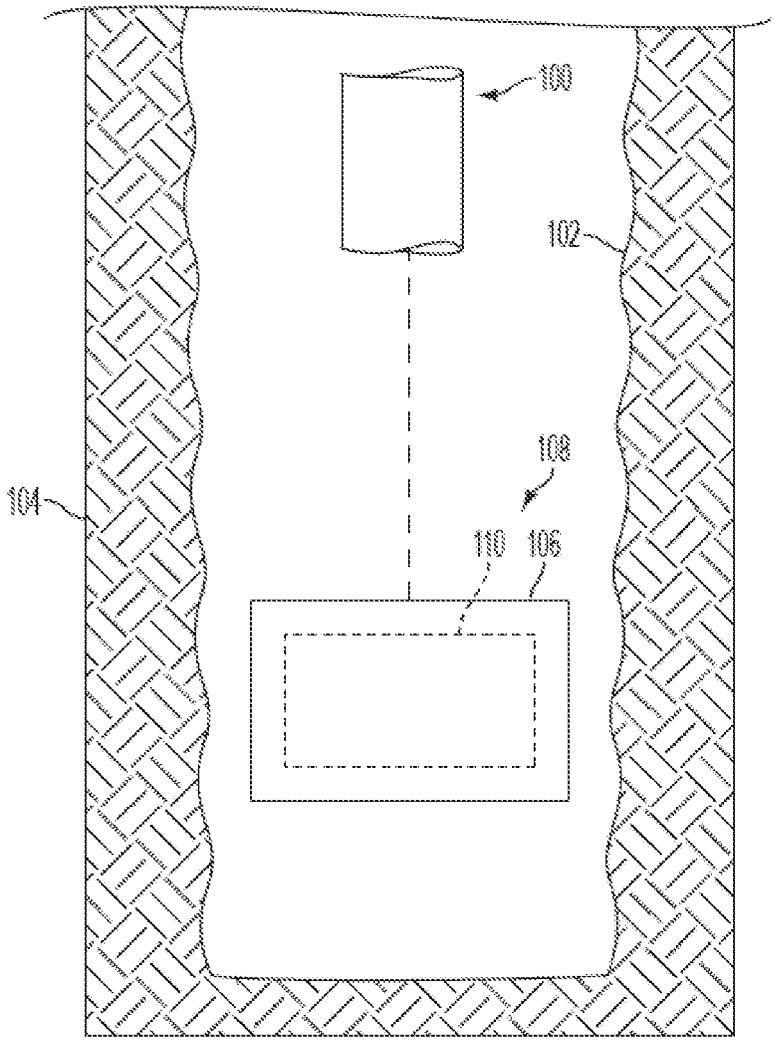
FIG. 1 is a longitudinal schematic view of a borided downhole assembly, formed in accordance with an embodiment of the disclosure.

Methods of forming borided downhole structures, tools, and assemblies are described, as are related downhole structures, tools, and assemblies. For example, in some embodiments, a method of forming a borided downhole tool includes inserting at least one downhole structure formed of and including a metal material, and at least two anodes into a molten electrolyte contained within a crucible to form an electrochemical cell. The downhole structure may serve as a cathode of the electrochemical cell. Electrical current is applied to the electrochemical cell to diffuse boron atoms from the molten electrolyte into the downhole structure and form at least one borided downhole structure formed of and including a metal boride material. The borided downhole structure may, optionally, be kept in the molten electrolyte material in the absence of electrical current for a sufficient period of time to facilitate phase homogenization of the metal boride material. The borided downhole structure may be secured to at least one other downhole structure to form a borided downhole tool. The borided downhole tool may be secured to at least one other downhole tool to form a borided downhole assembly. The borided downhole structures, tools, and assemblies of the disclosure may exhibit enhanced properties (e.g., enhanced mechanical strength, wear resistance, thermal resistance, chemical resistance, corrosion resistance, etc.) favorable to the use thereof in downhole applications. The methods of the disclosure may enable the borided downhole structures, tools, and assemblies to be formed in a simpler, faster, more cost-effective, and in a more environmentally friendly manner as compared to conventional methods.

The following description provides specific details, such as material types, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure, tool, or assembly. The structures described below do not form a complete tool or a complete assembly. Only those process acts and structures necessary to understand the embodiments of the disclosure are described in detail below. Additional acts to form the complete tool or the complete assembly from various structures may be performed by conventional fabrication techniques. The drawings accompanying the application are for illustrative purposes only, and are not drawn to scale. Additionally, elements common between figures may retain the same numerical designation.

Although some embodiments of the disclosure are depicted as being used and employed in particular downhole assemblies and components thereof, persons of ordinary skill in the art will understand that the embodiments of the disclosure may be employed in any downhole assembly (e.g., drilling assembly, conditioning assembly, completion assembly, logging assembly, measurement assembly, a monitoring assembly, etc.), drill bit, drill string, and/or component of any thereof where it is desirable to enhance at least one of the wear resistance, thermal resistance, and chemical resistance of the downhole assembly, drill bit, drill string, and/or component of any thereof during and/or after the formation of a wellbore in a subterranean formation. By way of non-limiting example, embodiments of the disclosure may be employed in earth-boring rotary drill bits, fixed-cutter drill bits, roller cone drill bits, hybrid drill bits employing both fixed and rotatable cutting structures, core drill bits, eccentric drill bits, bicenter drill bits, expandable reamers, expandable stabilizers, fixed stabilizers, mills, and other components of a downhole assembly or drill string as known in the art.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "substantially," in reference to a given parameter, property, or condition, means to a degree that one of ordinary skill in the art would understand that the given parameter, property, or condition is met with a small degree of variance, such as within acceptable manufacturing tolerances.

FIG. 1 is a longitudinal schematic representation of a borided downhole assembly 100 for use during and/or after the formation of a wellbore 102 within a subterranean formation 104. As shown in FIG. 1, the borided downhole assembly 100 may be provided into the wellbore 102. The borided downhole assembly 100 may include at least one borided downhole tool 108 formed in accordance with methods described hereinbelow. The borided downhole tool 108 may include at least one borided structure or component, such as at least one borided external structure 106, and/or at least one borided internal structure 110. If present, the borided external structure 106 may at least partially surround (e.g., contain, hold, shield, etc.) at least one other structure or component of the borided downhole tool 108, such as the borided internal structure 110. In turn, if present, the borided internal structure 110 may be at least partially surrounded (e.g., contained, held, shielded, etc.) by at least one other structure or component of the borided downhole tool 108, such as the borided external structure 106. In some embodiments, the borided downhole tool 108 comprises an earth-boring rotary drill bit including one or more of at least one borided internal surface (e.g., a borided bearing surface), and at least one borided external surface (e.g., a borided bit body surface, such as a borided bit blade surface).

An embodiment of the disclosure will now be described with reference to FIG. 2, which illustrates a simplified cross-sectional view of a configuration that may be used in a method of forming a borided downhole structure (e.g., at least one borided structure of the borided downhole tool 108 previously described with reference to FIG. 1, such as at least one of the borided external structure 106, and the borided internal structure 110) for a downhole tool and/or assembly, in accordance with embodiments of the disclosure. The method includes providing a molten electrolyte 206, at least one downhole structure 202, and at least two anodes 212 into a crucible 204 to form an electrochemical cell 200. Electrical current is then applied to the electrochemical cell 200 to boronize the downhole structure 202. With the description as provided below, it will be readily apparent to one of ordinary skill in the art that the method described herein may be used in various applications. In other words, the method may be used whenever it is desired to form a borided structure for a downhole application (e.g., a drilling application, a conditioning application, a logging application, a measurement application, a monitoring application).

The crucible 204 may be any vessel or container configured and of a material suitable for holding the molten electrolyte 206 before, during, and after the electrochemical boriding process of the disclosure, as described in further detail below. By way of non-limiting example, the crucible 204 may comprise a silicon carbide (SiC) crucible configured to receive and hold the molten electrolyte 206, the downhole structure 202, and the at least two anodes 212. In additional embodiments, the crucible 204 may be formed of and include nitride bonded SiC bricks. In further embodiments, the crucible 204 may be formed of and include an electrically conductive material that may serve as an anode during the electrochemical boronizing process. For example, the crucible 204 may be formed of and include a graphite material. The crucible 204 may be operatively associated with (e.g., connected to) at least one heating device (e.g., combustion heater, electrical resistance heater, inductive heater, electromagnetic heater, etc.) configured and operated to achieve and/or maintain a desired temperature of the molten electrolyte 206.

The molten electrolyte 206 may comprise at least one boron-containing material formulated for depositing boron (B) atoms onto and within the downhole structure 202 during the electrochemical boronizing process, as described in further detail below. For example, the molten electrolyte 206 may comprise at least one of sodium tetraborate ($Na_2B_4O_7$) (often referred to as "borax"), potassium borofluoride ($KBF_4$), a boric acid, a boron oxide, and a borate of an element of Group 1 (e.g., lithium, sodium, potassium) or Group 2 (e.g., beryllium, magnesium, calcium, strontium, barium) of the Periodic Table of Elements. In some embodiments, the molten electrolyte 206 comprises about 100 percent by weight (wt %) molten anhydrous $Na_2B_4O_7$. In additional embodiments, the molten electrolyte 206 comprises a molten mixture of a boron-containing material (e.g., $Na_2B_4O_7$) and at least one other material, such as at least one of sodium fluoride (NaF), sodium chloride (NaCl), sodium hydroxide (NaOH), sodium carbonate ($Na_2CO_3$), sodium sulfite ($Na_2SO_3$), sodium phosphate ($Na_3PO_4$), calcium chloride ($CaCl_2$), lithium chloride (LiCl), barium chloride ($BaCl_2$), and lead oxide (PbO). The at least one other material may, for example, comprise from about 0 wt % to about 50 wt % of the molten electrolyte 206, with the at least one boron-containing material comprising a remainder of the molten electrolyte 206. By way of non-limiting example, the molten electrolyte 206 may comprise from about 50 wt % to about 90 wt % of the at least one boron-containing material, and from about 10 wt % to about 50 wt % of the at least one other material. In some embodiments, the molten electrolyte 206 comprises from about 50 wt % to about 90 wt % $Na_2B_4O_7$, and from about 10 wt % to about 50 wt % of at least one of $Na_2SO_3$, NaOH, $Na_3PO_4$, and PbO.

A temperature of the molten electrolyte 206 may be within a range of from about 550° C. to about 1400° C. The temperature of the molten electrolyte 206 may at least partially depend on the material composition of the molten electrolyte 206. The temperature of the molten electrolyte 206 may be at or above a melting point temperature of a solid precursor to the molten electrolyte 206. As a non-limiting example, in embodiments where the molten electrolyte 206 comprises a boron-containing material (e.g., from about 50 wt % to about 90 wt % $Na_2B_4O_7$) and at least one other component (e.g., from about 10 wt % to about 50 wt % of at least one of $Na_2SO_3$, NaOH, $Na_3PO_4$, PbO, etc.), the temperature of the molten electrolyte 206 may be within a range of from about 550° C. to about 700° C. As another non-limiting example, in embodiments where the molten electrolyte 206 comprises about 100 wt % of the boron-containing material (e.g., about 100 wt % $Na_2B_4O_7$), the temperature of the molten electrolyte 206 may be within a range of from about 770° C. to about 1400° C., such as from about 850° C. to about 1200° C., from about 900° C. to about 1100° C., or from about 950° C. to about 1000° C. In some embodiments, the molten electrolyte 206 comprises 100 wt % $Na_2B_4O_7$, and the temperature of the molten electrolyte 206 is within a range of from about 950° C. to about 1000° C. The molten electrolyte 206 may be formed within the crucible 204 (e.g., by heating the crucible 204 at least to the melting point of a solid precursor to the molten electrolyte 206), or may be formed outside the crucible 204 and then delivered into the crucible 204.

The anodes 212 may independently be formed of and include an electrically conductive material capable of withstanding the conditions (e.g., temperatures, materials, etc.) within the crucible 204. By way of non-limiting example, each of the anodes 212 may be formed of and include graphite. In embodiments where the crucible 204 is configured to serve as an anode (e.g., where the crucible 204 is formed of and includes graphite), one or more of the anodes 212 may, optionally, be omitted. While various embodiments herein describe or illustrate the electrochemical cell 200 as including two anodes 212 the electrochemical cell 200 may, alternatively, include a different number of anodes 212. The number of anodes 212 provided into the molten electrolyte 206 may at least partially depend on the number of downhole structures 202 to provided within the molten electrolyte 206. As a non-limiting example, if more than one downhole structure 202 is provided into the molten electrolyte 206, more than two anodes 212 may also be provided into the molten electrolyte 206.

Figure 2:
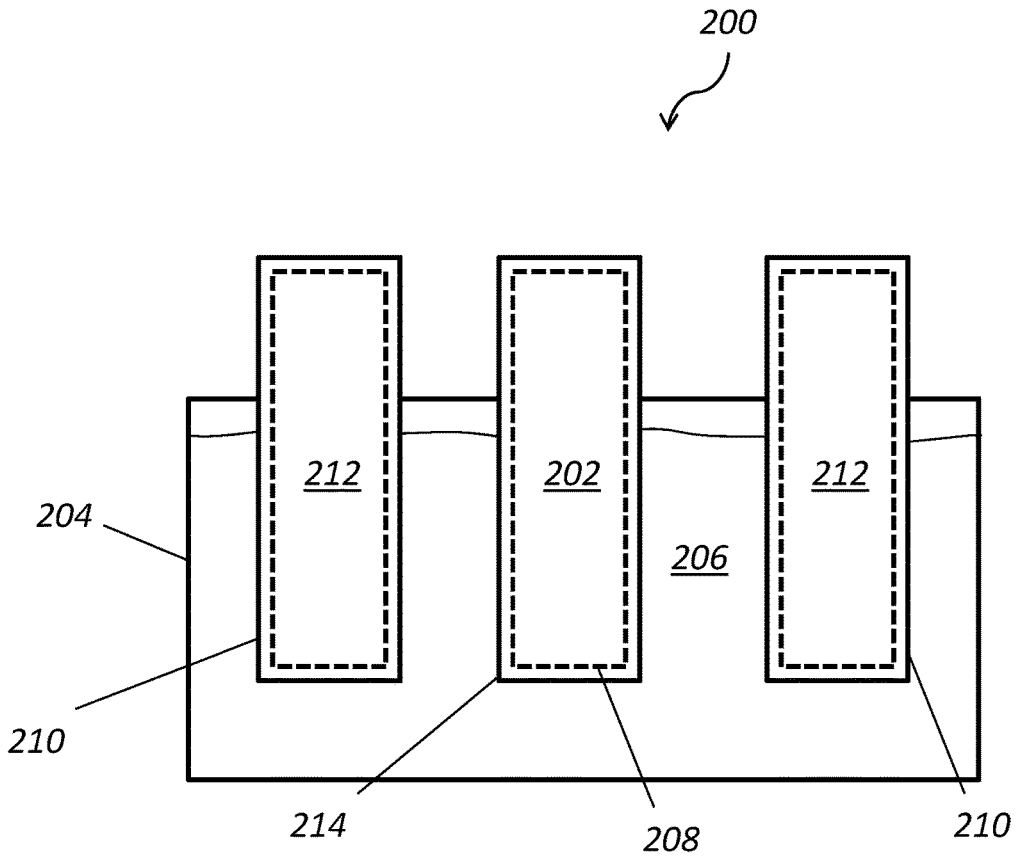
FIG. 2 is a simplified cross-sectional view of an electrochemical cell for producing a borided downhole structure, in accordance with embodiments of the disclosure.

As depicted in FIG. 2, the anodes 212 may be electrically connected (e.g., directly connected, or indirectly connected) to fixtures 210 configured (e.g., sized and shaped) to position, and hold or contain the anodes 212 within the crucible 204. The anodes 212 may be integral with their respective fixtures 210 (i.e., at least one of the anodes 212 and at least one of the fixtures 210 may comprise a single structure), or may be discrete from their respective fixtures 210 (i.e., at least one of the anodes 212 and at least one of the fixtures 210 may comprise different, connected structures). If the anodes 212 and their respective fixtures 210 are discrete structures, the fixtures 210 and the anodes 212 may be formed of and include the same material, or may be formed of and include different materials (e.g., different electrically conductive materials). In addition, if discrete structures, the anodes 212 and their respective fixtures 210 may be coupled to one another through conventional means which are not described in detail herein.

The downhole structure 202 may comprise any structure associated with a downhole tool and/or assembly. Accordingly, the downhole structure 202 may exhibit a desired shape (i.e., geometric configuration) and size, such as a shape and size associated with a conventional structure or component of a downhole tool. For example, the downhole structure 202 may exhibit a conical shape, tubular shape, a pyramidal shape, a cubical shape, cuboidal shape, a spherical shape, a hemispherical shape, a cylindrical shape, a semi cylindrical shape, truncated versions thereof, or an irregular shape. Irregular shapes include complex shapes, such as shapes associated with downhole tools and/or assemblies. In some embodiments, the downhole structure 202 exhibits the shape of a structure (e.g., an internal structure, such as a bearing; or an external structure, such as a blade, wear insert, cutting element, roller cone, roller cone insert, etc.) of a earth-boring rotary drill bit (e.g., a fixed-cutter drill bit, a roller cone drill bit, a hybrid drill bit employing both fixed and rotatable cutting structures, a core drill bit, an eccentric drill bit, a bicenter drill bit, etc.), a completion tool (e.g., a packer, a screen, a bridge plug, a latch, a shoe, a nipple, a barrier, a sleeve, a valve, a pump, etc.), an expandable reamer, an expandable stabilizer, a fixed stabilizer, a slip-on stabilizer, a clamped-on stabilizer, an integral stabilizer, an ONTRAK™ tool, an optimized rotational density tool, an AZIONTRAK™ tool, a slimhole neutron density tool, a calibrated neutron density tool, a drill motor, a bearing, an upper bearing housing, a lower bearing housings, a mud motor, a rotor, a stator, a pump, or a valve.

As depicted in FIG. 2, the downhole structure 202 may be electrically connected (e.g., directly connected, or indirectly connected) to at least one fixture 214 configured (e.g., sized and shaped) to position, and hold or contain the downhole structure 202 within the crucible 204. The fixture 214 be formed of and include an electrically conductive material capable of withstanding the conditions (e.g., temperature, materials, etc.) within the crucible 204. The downhole structure 202 may be integral with the fixture 214 (i.e., downhole structure 202 and the fixture 214 may comprise a single structure), or may be discrete from the fixture 214 (i.e., the downhole structure 202 and the fixture 214 may comprise different, connected structures). If the downhole structure 202 and the fixture 214 are discrete structures, the fixture 214 and the downhole structure 202 may be formed of and include the same material, or may be formed of and include different materials (e.g., different electrically conductive materials). In addition, if discrete structures, the downhole structure 202 and the fixture 214 and may be coupled to one another through conventional means which are not described in detail herein.

While various embodiments herein describe or illustrate a single downhole structure 202 within the crucible 204, multiple downhole structures may be provided within the crucible 204. The multiple downhole structures may be held by a single fixture (e.g., the fixture 214) within the crucible 204, or may be held by multiple fixtures within the crucible 204. Each of the downhole structures may be substantially the same, or at least one of the downhole structures may be different than at least one other of the downhole structures. Providing multiple downhole structures within the crucible 204 may facilitate the simultaneous formation of multiple downhole tools and/or assemblies. By way of non-limiting example, the crucible 204 may be at least partially filled with a plurality of downhole structures such that at least a portion of each of the downhole structures (e.g., the downhole structure 202) is borided during subsequent electrochemical boronizing processing.

The downhole structure 202 may be at least partially formed of (e.g., a laminate or other composite structure) and include a metal material capable of forming a hard, wear resistant (e.g., abrasion resistant, erosion resistant), and chemically resistant (e.g., corrosion resistant) metal boride material when subjected to the electrochemical boronizing process of the disclosure. The downhole structure 202 may, for example, be at least partially formed of and include iron (Fe), cobalt (Co), nickel (Ni), copper (Cu), tungsten (W), titanium (Ti), molybdenum (Mo), niobium (Nb), vanadium (V), hafnium (Hf), tantalum (Ta), chromium (Cr), zirconium (Zr), aluminum (Al), silicon (Si), carbides thereof, nitrides thereof, oxides thereof, alloys thereof, or combinations thereof. The downhole structure 202 may serve as a cathode of the electrochemical cell 200.

As a non-limiting example, the downhole structure 202 may be formed of and include a metal alloy, such as at least one of an Fe-containing alloy, a Ni-containing alloy, a Co-containing alloy, an Fe- and Ni-containing alloy, a Co- and Ni-containing alloy, an Fe- and Co-containing alloy, an Al-containing alloy, a Cu-containing alloy, a Mg-containing alloy, and a Ti-containing alloy. In some embodiments, the downhole structure 202 is formed of and includes a Fe-containing alloy (e.g., a steel-alloy). Suitable Fe-containing alloys are commercially available from numerous sources, such as from Special Metals Corp., of New Hartford, N.Y., under the trade name INCONEL® (e.g., INCONEL® 945, INCONEL® 925, INCONEL® 745, INCONEL® 718, INCONEL® 600, etc.), and from Schoeller Bleckmann Sales Co. of Houston, Tex. (e.g., P550 alloy steel, P650 alloy steel, P750 alloy steel, etc.). The downhole structure 202 may, for example, be formed of and include at least one of AISI 4815 alloy steel, AISI 4130M7 alloy steel, AISI 4140 alloy steel, AISI 4145H alloy steel, AISI 4715 alloy steel, AISI 8620 alloy steel, AISI 8630 alloy steel, SAE PS55 alloy steel, P550 alloy steel, P650 alloy steel, P750 alloy steel, INCONEL® 945, INCONEL® 925, and INCONEL® 745. In some embodiments, the downhole structure 202 is formed of and includes at least one of AISI 4815 alloy steel, and AISI 4140 alloy steel.

As an additional non-limiting example, the downhole structure 202 may be formed of and include a ceramic-metal composite material (i.e., a "cermet" material). The ceramic-metal composite material may include hard ceramic phase particles (or regions) dispersed throughout a matrix of metal material. The hard ceramic phase particles may comprise carbides, nitrides, and/or oxides, such as carbides of at least one of W, Ti, Mo, Nb, V, Hf, Ta, Cr, Zr, Al, and Si. For example, the hard ceramic phase particles may comprise one or more of tungsten carbide (WC), fused tungsten carbide ($WC/W_2C$ eutectic), titanium carbide (TIC), tantalum carbide (TaC), chromium carbide (CrC), titanium nitride (TiN), aluminum oxide ($Al_2O_3$), aluminum nitride (AlN), and silicon carbide (SiC). The hard ceramic phase particles may be substantially free of anomalies (e.g., attached materials, structures, etc.) that may otherwise impede or even prevent desired boronization of the hard ceramic phase particles. The hard ceramic phase particles may be monodisperse, wherein all of the hard ceramic phase particles are of substantially the same size, or may be polydisperse, wherein the hard ceramic phase particles have a range of sizes and are averaged. The matrix of metal material may, for example, comprise at least one of an Fe-containing alloy, a Ni-containing alloy, a Co-containing alloy, an Fe- and Ni-containing alloy, a Co- and Ni-containing alloy, an Fe- and Co-containing alloy, an Al-containing alloy, a Cu-containing alloy, a Mg-containing alloy, and a Ti-containing alloy. The matrix of metal material may also be selected from commercially pure elements such as Ni, Fe, Co, Al, Cu, Mg, and Ti. In some embodiments, the downhole structure 202 is formed of and includes a ceramic-metal composite material comprising WC particles dispersed throughout a matrix of Ni.

The downhole structure 202 may be conditioned to improve one or more properties thereof (e.g., thermal resistance, hardness, toughness, chemical resistance, wear resistance, friction coefficient, mechanical strength, etc.) prior to performing the electrochemical boronizing process of the disclosure. By way of non-limiting example, at least a portion of the downhole structure 202 may be subjected to a conventional carburization process prior to being provided into the molten electrolyte 206 within the crucible 204. The downhole structure 202 may, for example, comprise an at least partially carburized metal material, such as an at least partially carburized metal (e.g., Fe, Ni, Co, W, Ti, Mo, Nb, V, Hf, Ta, Cr, Zr, Al, etc.), and/or an at least partially carburized metal alloy (e.g., an Fe-containing alloy, a Ni-containing alloy, a Co-containing alloy, an Fe- and Ni-containing alloy, a Co- and Ni-containing alloy, an Fe- and Co-containing alloy, an Al-containing alloy, a Cu-containing alloy, a Mg-containing alloy, a Ti-containing alloy, etc.). In some embodiments, the downhole structure 202 comprises a carburized Fe-containing alloy (e.g., a carburized steel alloy). In additional embodiments, the downhole structure 202 comprises a carburized ceramic-metal composite material.

The downhole structure 202 may be cleaned prior to performing the electrochemical boronizing process of the disclosure. For example, at least a portion of the downhole structure 202 may be subjected to a conventional cleaning process (e.g., a conventional volatilization process) prior to being provided into the molten electrolyte 206 within the crucible 204. The cleaning process may remove anomalies (e.g., attached materials, structures, etc.) from one or more surface(s) of the downhole structure 202 that may otherwise impede or even prevent desired boronization of the downhole structure 202.

The downhole structure 202 may have a substantially homogeneous distribution of the metal material, or may include a substantially heterogeneous distribution of the metal material. As used herein, the term "homogeneous distribution" means that amounts of a material (e.g., the metal material) do not vary throughout different portions (e.g., different lateral and longitudinal portions) of a structure. For example, if the downhole structure 202 includes a substantially homogeneous distribution of the metal material, amounts of the metal material may not vary throughout different portions of the downhole structure 202. The downhole structure 202 may, for example, comprise a bulk structure of the metal material. In contrast, as used herein, the term "heterogeneous distribution" means amounts of a material (e.g., a metal material) vary throughout different portions of a structure. Amounts of the material may vary stepwise (e.g., change abruptly), or may vary continuously (e.g., change progressively, such as linearly, parabolically, etc.) throughout different portions of the structure. For example, if the downhole structure 202 includes a substantially heterogeneous distribution of the metal material, amounts of the metal material may vary throughout at least one of different lateral portions and different longitudinal portions of the downhole structure 202. The downhole structure 202 may, for example, include an at least partial coating of the metal material on another material. If the downhole structure 202 is formed of or includes a ceramic-metal composite material, the downhole structure 202 may have a substantially homogeneous distribution of the ceramic-metal composite material, or may have a substantially heterogeneous distribution of the ceramic-metal composite material. In addition, the ceramic-metal composite material may include a substantially homogeneous distribution of the hard ceramic phase particles, or may include a substantially heterogeneous distribution of the hard ceramic phase particles.

Regardless of whether the metal material (and/or the ceramic-metal composite material) is homogeneously distributed or heterogeneously distributed, the downhole structure 202 may include at least one metal-containing surface 208. As used herein, the term "metal-containing surface" means and includes a surface at least partially formed of and including the metal material (e.g., Fe, Ni, W, Co, Cu, Ti, Mo, Nb, V, Hf, Ta, Cr, Zr, Si, alloys thereof, combinations thereof, etc.). The metal-containing surface 208 may, for example, comprise at least one of an Fe-containing surface, an Ni-containing surface, a Co-containing surface, and a W-containing surface. The metal-containing surface 208 may be substantially free of anomalies (e.g., attached materials, structures, etc.) which may otherwise impede or even prevent desired boronization of the metal-containing surface 208. The metal-containing surface may be converted to a metal boride-containing surface upon exposure to the electrochemical boronizing process, as described in further detail below. As used herein, the term "metal boride-containing surface" means and includes a surface at least partially formed of and including the metal boride material (e.g., an Fe boride, such as FeB, and/or $Fe_2B$; a Ni boride, such as NiB, $Ni_2B$, $Ni_3B$ and/or $Ni_4B_3$; a W boride, such as WB, $WB_2$, $W_2B_5$, and/or $WB_4$; a Co boride, such as CoB, $Co_2B$, and/or $Co_3B$; a Cu boride; a Ti boride, such as TiB, and/or $TiB_2$; a Mo boride, such as MoB, $Mo_2B$, $MoB_2$, $Mo_2B_5$, and/or $MoB_4$; a Nb boride, such as NbB, and/or $NbB_2$; a V boride, such as VB, $VB_2$, and/or $V_2B_5$; a Hf boride, such as $HfB_2$; a Ta boride, such as $TaB_2$; a Cr boride, such as CrB, and/or $Cr_2B$; a Zr boride, such as $ZrB_2$; a Si boride; combinations thereof; etc.). In some embodiments, each surface of the downhole structure 202 comprises a metal-containing surface. In additional embodiments, the downhole structure 202 includes at least one metal-containing surface and at least one non-metal-containing surface. By way of non-limiting example, an outer surface of the downhole structure 202 may comprise a metal-containing surface, and an inner surface of the downhole structure 202 may comprise a non-metal-containing surface.

An entirety of the metal-containing surface 208 of the downhole structure 202 may be exposed to the molten electrolyte 206, or less than an entirety of the metal-containing surface 208 of the downhole structure 202 may be exposed to the molten electrolyte 206. For example, at least one portion of the metal-containing surface 208 of the downhole structure 202 may be covered or masked to substantially limit or prevent the boronization thereof during the electrochemical boronizing process. As another example, only a portion of the metal-containing surface 208 of the downhole structure 202 may be provided (e.g., immersed, submerged, soaked, etc.) in the molten electrolyte 206. In some embodiments, an entirety of the metal-containing surface 208 of the downhole structure 202 is exposed to the molten electrolyte 206 in the crucible 204.

With continued reference to FIG. 2, electrical current may be applied to the electrochemical cell 200 to boronize the downhole structure 202. By way of non-limiting example, in embodiments where the molten electrolyte 206 comprises 100 wt % molten $Na_2B_4O_7$, the applied electrical current may facilitate the extraction and deposition of B atoms on at least the metal-containing surface 208 of the downhole structure 202 through the following reactions:

$$2Na_2B_4O_7 \rightarrow 2Na_2B_2O_4 + 2B_2O_3 \quad (1),$$

$$Na_2B_2O_4 \rightarrow 2Na^+ + B_2O_4^{2-} \quad (2),$$

$$B_2O_4^{2-} \rightarrow B_2O_3 + \tfrac{1}{2}O_2 + 2e^- \quad (3),$$

$$2Na^+ + 2e^- \rightarrow 2Na \quad (4),$$

$$6Na + 2B_2O_3 \rightarrow 3Na_2O_2 + 4B \quad (5).$$

Figure 3:
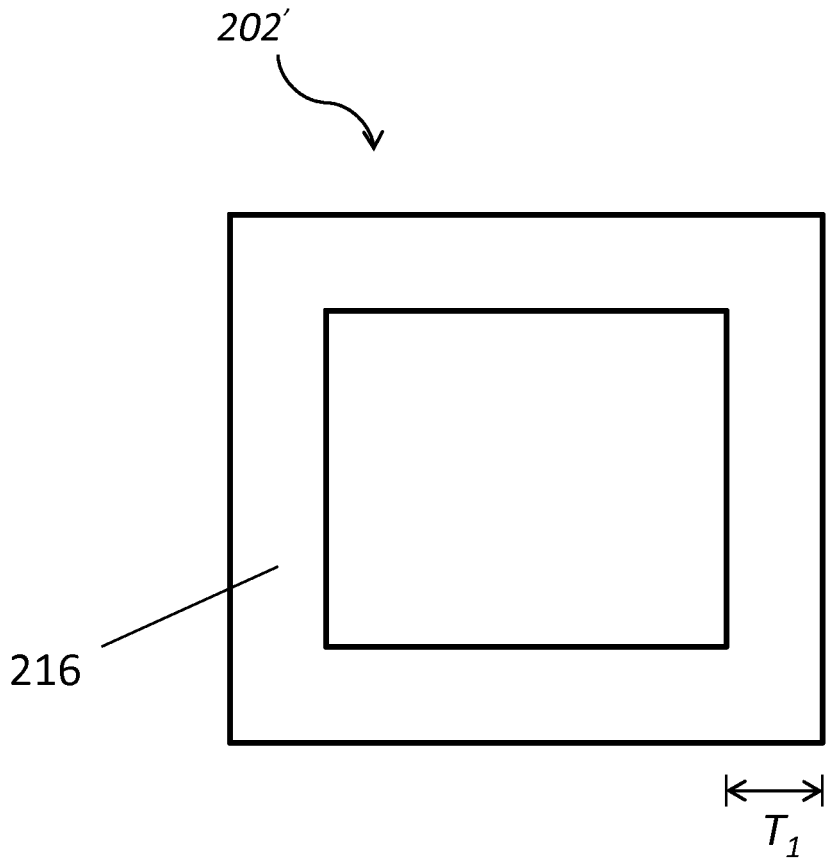
FIG. 3 is a simplified cross-sectional view of a borided downhole structure, formed in accordance with an embodiment of the disclosure.

In additional embodiments where the molten electrolyte 206 includes at least one other material (e.g., at least one of NaF, NaCl, NaOH, $Na_2CO_3$, $Na_3PO_4$, $Na_2SO_3$, $CaCl_2$, LiCl, $BaCl_2$, and PbO), the other material may enhance or accelerate the extraction and deposition of B atoms from the boron-containing material (e.g., $Na_2B_4O_7$, $KBF_4$, a boric acid, a boron oxide, a borate of an element of Group 1 or Group 2 of the Periodic Table of Elements, etc.). The boron atoms may infiltrate or permeate the downhole structure 202, and may react with at least a portion of the metal material thereof to form a boronized downhole structure 202' including at least one metal boride material 216, as depicted in FIG. 3. As a non-limiting example, if the downhole structure 202 is formed of and includes an Fe-containing alloy (e.g., a steel alloy, such as AISI 4815 alloy steel, AISI 4130M7 alloy steel, AISI 4140 alloy steel, AISI 4145H alloy steel, AISI 4715 alloy steel, AISI 8620 alloy steel, AISI 8630 alloy steel, SAE PS55 alloy steel, P550 alloy steel, P650 alloy steel, P750 alloy steel, INCONEL® 945, INCONEL® 925, INCONEL® 745, etc.), the liberated B atoms may diffuse into the downhole structure 202 (FIG. 2) and react with the Fe atoms thereof to form a metal boride material 216 comprising at least one Fe boride phase through the following reactions:

$$2Fe+B \rightarrow Fe_2B \quad (6),$$

$$Fe_2B+B \rightarrow 2FeB \quad (7).$$

As another non-limiting example, if the downhole structure 202 is formed of and includes a ceramic-metal composite material (e.g., WC particles in a matrix of a metal material, such as a matrix of Ni), the liberated B atoms may diffuse into the downhole structure 202 (FIG. 2) and react with the metal atoms of at least one of the hard ceramic phase particles and the matrix of metal material to form a metal boride material 216 comprising hard ceramic phase particles in a matrix of at least one metal boride (e.g., WC particles in a matrix of at least one of a Ni boride and a W boride).

The metal boride material 216 may comprise a single layer of material, or may comprise multiple layers of material. If the metal boride material 216 comprises a single layer of material, the single layer of material may comprise multiple metal boride phases (e.g., $Fe_2B$ and FeB), or may comprise a single metal boride phase (e.g., $Fe_2B$ or FeB). In addition, if the metal boride material 216 comprises a multiple layers of material, at least one of the layers may include a different amount of at least one metal boride phase (e.g., $Fe_2B$ or FeB) than at least one other of the layers. The metal boride material 216 may also comprise multiple metal borides. For example, if the downhole structure 202 is formed of and includes an Fe-containing alloy including Cr, the metal boride material 216 may comprise at least one Fe boride (e.g., $Fe_2B$ and/or FeB) and at least one Cr boride (e.g., $Cr_2B$ and/or CrB). As another example, if the downhole structure 202 is formed of and includes a ceramic-metal composite material including WC particles dispersed in a matrix of Ni, the metal boride material 216 may comprise WC particles within a matrix of at least one Ni boride and at least one W boride.

With reference to FIG. 3, electrical current may be applied to the electrochemical cell 200 (FIG. 2) for a sufficient period of time to form the metal boride material 216 to a desired thickness $T_1$, such as a thickness $T_1$ within a range of from about 5 micrometers (μm) to about 400 micrometers (μm). The duration of the applied electrical current, and the resulting thickness $T_1$ and material composition of the metal boride material 216 may at least partially depend on the material composition of the downhole structure 202 (FIG. 2), the material composition and temperature of the molten electrolyte 206 (FIG. 2), and the applied current density. By way of non-limiting example, the applied current density may be within a range of from about 50 milliamperes per square centimeter ($mA/cm^2$) to about 700 $mA/cm^2$ (e.g., from about 100 $mA/cm^2$ to about 500 $mA/cm^2$, from about 100 $mA/cm^2$ to about 300 $mA/cm^2$, or from about 100 $mA/cm^2$ to about 200 $mA/cm^2$), and the duration of the applied electrical current may be within a range of from about 1 minute to about 5 hours (e.g., from about 1 minute to about 2 hours, or from about 1 minute to about 1 hour). In some embodiments, the current density is within a range of from about 100 $mA/cm^2$ to about 200 $mA/cm^2$, and the duration of the applied electrical current is within a range of from about 1 minute to about 2 hours.

Following the formation of the metal boride material 216, the applied electrical current may be discontinued, and the borided downhole structure 202' may, optionally, be kept in the molten electrolyte 206 (FIG. 2) for an additional period of time. Keeping the borided downhole structure 202' in the molten electrolyte 206 in the absence of the applied electrical current (i.e., without any polarization) may facilitate phase homogenization in the metal boride material 216. By way of non-limiting example, in embodiments where the metal boride material 216 comprises an $Fe_2B$ phase and an FeB phase (e.g., in a single layer, in separate layers, or a combination thereof), keeping the borided downhole structure 202' in the molten electrolyte 206 for an additional period of time may enable at least a portion of the FeB phase of the metal boride material 216 to be converted to the $Fe_2B$ phase. As compared the FeB phase, the $Fe_2B$ phase may exhibit properties (e.g., improved toughness, improved hardness, etc.) favorable to the use of the borided downhole structure 202' in downhole applications. In some embodiments, substantially all of the FeB phase may be converted to the $Fe_2B$ phase. As a non-limiting example, after discontinuing the applied electrical current, the borided downhole structure 202' may be kept in the molten electrolyte 206 for a period of time with a range of from about 10 minutes to about two (2) hours (e.g., from about 15 minutes to about 45 minutes, or from about 15 minutes to about 30 minutes). In additional embodiments, the borided downhole structure 202' may be removed from the molten electrolyte 206 without keeping the borided downhole structure 202' in the molten electrolyte 206 for the additional period of time (i.e., without keeping the borided downhole structure 202 in the molten electrolyte 206 for a period of time greater than or equal to about 10 minutes). In further embodiments, the borided downhole structure 202' may be removed from the molten electrolyte 206 without keeping the borided downhole structure 202' in the molten electrolyte 206 for the additional period of time, and may be provided into a different device or apparatus (e.g., a high temperature furnace) configured and operated to facilitate phase homogenization in the metal boride material 216.

The borided downhole structure 202' may be removed from the crucible 204 (and the fixture 214), and may, optionally, be subjected to additional processing or conditioning. Additional processing may, for example, be utilized to enhance one or more properties of the borided downhole structure 202' (e.g., thermal resistance, hardness, toughness, chemical resistance, corrosion resistance, wear resistance, lower friction coefficient, mechanical strength, etc.). By way of non-limiting example, at least a portion of the borided downhole structure 202' may be subjected to a conventional carburization process. For example, borided portions of the borided downhole structure 202' may be covered or masked, and at least one non-borided portion of the borided downhole structure 202' may be conventionally carburized. The additional processing may also be utilized to prepare (e.g., shape, size, condition, etc.) the borided downhole structure 202' to be secured to at least one other structure to form a desired downhole tool (e.g., an earth-boring rotary drill bit, an expandable reamer, an expandable stabilizer, a fixed stabilizer, a rotor, a stator, a pump, a valve, etc.).

Following formation (and, optionally, additional processing), the borided downhole structure 202' may be secured to (e.g., directly or indirectly attached to, provided within, etc.) at least one other structure to form a desired borided downhole tool (e.g., the borided downhole tool 108 previously described in relation to FIG. 1). The other structure may be substantially the same as the borided downhole structure 202' (e.g., may exhibit substantially the same shape, size, and material configuration as the borided downhole structure 202), or may be different than the borided downhole structure 202' (e.g., may exhibit at least one of a different shape, a different size, and a different material configuration than the borided downhole structure 202'). For example, the other structure may comprise another borided downhole structure, or may comprise a non-borided downhole structure (i.e., a structure substantially free of at least one metal boride material). If the other structure comprises another borided downhole structure, the other structure may have substantially the same shape, size, and material configuration as the borided downhole structure 202', or may have at least one of a different shape, different size, and different material configuration than the borided downhole structure 202'. In some embodiments, the other structure exhibits a different thickness of a metal boride material than the borided downhole structure 202'.

The borided downhole tool (e.g., the borided downhole tool 108 previously described in relation to FIG. 1) including the borided downhole structure 202' may be secured (i.e., directly secured, or indirectly secured) to at least one other downhole tool to form a borided downhole assembly (e.g., the borided downhole assembly 100 previously described in relation to FIG. 1). The other downhole tool may comprise another borided downhole tool, or may comprise a non-borided downhole tool. If the other downhole tool comprises another borided downhole tool, the other downhole tool may have substantially the same shape, size, and material configuration as the borided downhole tool, or may have at least one of a different shape, a different size, and a different material configuration than the borided downhole tool. In some embodiments, the other downhole tool exhibits a different thickness of a metal boride material than the borided downhole tool.

The methods of the disclosure facilitate the fast, simple, cost-effective, and environmentally friendly formation of borided downhole structures, tools, and assemblies able to withstand the aggressive environmental conditions (e.g., abrasive materials, corrosive chemicals, high temperatures, high pressures, etc.) frequently experienced in downhole applications (e.g., drilling applications, conditioning applications, logging applications, measurement applications, monitoring applications, etc.). The borided downhole structures, tools, and assemblies formed by the methods of the disclosure may also exhibit improved properties (e.g., metal boride material thickness and homogeneity, hardness, toughness, chemical resistance, etc.) as compared to borided downhole structures formed by many conventional boronizing processes. As a result, the methods of the disclosure may be used to form borided downhole structures, tools, and assemblies more rapidly and uniformly, improving production efficiency and increasing the quality and longevity of the downhole structures, tools, and assemblies produced.

While the disclosure has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

What is claimed is:

1. A method of forming a downhole tool, comprising:

directly contacting a surface of a metal material of a downhole structure with a molten electrolyte consisting of anhydrous $Na_2B_4O_7$, the metal material consisting of AISI 4815 alloy steel, AISI 4130M7 alloy steel, AISI 4140 alloy steel, AISI 4145H alloy steel, AISI 4715 alloy steel, AISI 8620 alloy steel, AISI 8630 alloy steel, SAE PS55 alloy steel, P550 alloy steel, P650 alloy steel, or P750 alloy steel;

applying electrical current to the downhole structure to convert at least a portion of the metal material into a metal boride material and form a borided downhole structure;

masking the metal boride material; and carburizing at least one non-borided portion of the borided downhole structure after masking the metal boride material.

2. The method of claim 1, wherein directly contacting a surface of a metal material of a downhole structure further comprises selecting the at least one downhole structure to comprise a component of an earth-boring rotary drill bit, a completion tool, an expandable reamer, an expandable stabilizer, a fixed stabilizer, a slip-on stabilizer, a clamped-on stabilizer, an integral stabilizer, an optimized rotational density tool, a slimhole neutron density tool, a calibrated neutron density tool, a drill motor, a bearing, an upper bearing housing, a lower bearing housing, a rotor, a stator, a pump, or a valve.

3. The method of claim 1, further comprising selecting the metal material to consist of AISI 4815 alloy steel or AISI 4140 alloy steel.

4. The method of claim 1, further comprising selecting the downhole structure to comprise a layer of the metal material at least partially coating another material.

5. The method of claim 1, wherein directly contacting a surface of a metal material of a downhole structure with a molten electrolyte comprises exposing only a portion of the metal material to the molten electrolyte.

6. The method of claim 1, further comprising maintaining a temperature of the molten electrolyte within a range of from about 770° C. to about 1400° C.

7. The method of claim 1, wherein applying electrical current to the downhole structure comprises applying a current density within a range of from about 100 $mA/cm^2$ to about 700 $mA/cm^2$ for a period of time within a range of from about 1 minute to about 5 hours.

8. The method of claim 1, further comprising soaking the borided downhole structure in the molten electrolyte in the absence of the electrical current after the application thereof to increase the phase homogeneity of the metal boride material.

9. The method of claim 8, wherein soaking the borided downhole structure in the molten electrolyte in the absence of the electrical current after application thereof comprises at least partially immersing the borided downhole structure in the molten electrolyte for a period of time within a range of from about one (1) minute to about one (1) hour.

10. The method of claim 8, wherein soaking the borided downhole structure in the molten electrolyte in the absence of the electrical current after application thereof to increase the phase homogeneity of the metal boride material comprises converting FeB within the metal boride material to $Fe_2B$.

11. A method of forming a downhole tool, comprising:

at least partially inserting a surface of a metal material of a downhole structure into a molten electrolyte consisting of anhydrous $Na_2B_4O_7$ at a temperature of from about 770° C. to about 1400° C., the metal material consisting of AISI 4815 alloy steel, AISI 4130M7 alloy steel, AISI 4140 alloy steel, AISI 4145H alloy steel, AISI 4715 alloy steel, AISI 8620 alloy steel, AISI 8630 alloy steel, SAE PS55 alloy steel, P550 alloy steel, P650 alloy steel, or P750 alloy steel;

applying electrical current to the downhole structure for a period of time within a range of from about one minute to about five hours to convert at least a portion of the metal material into a metal boride material and form a borided downhole structure;

masking the metal boride material;

carburizing at least one non-borided portion of the borided downhole structure after masking the metal boride material; and securing the borided downhole structure to another downhole structure.

12. The method of claim 11, wherein securing the borided downhole structure to another downhole structure comprises securing the borided downhole structure to another borided downhole structure.

13. The method of claim 12, wherein securing the borided downhole structure to another borided downhole structure comprises securing the borided downhole structure to another structure exhibiting a different thickness of the metal boride material than the borided downhole structure.

14. The method of claim 11, wherein securing the borided downhole structure to another downhole structure comprises coupling the borided downhole structure with the another downhole structure to form an earth-boring rotary drill bit, an expandable reamer, an expandable stabilizer, a fixed stabilizer, a rotor, a stator, a pump, or a valve.

15. The method of claim 1, further comprising selecting the downhole structure to comprise a layer of the metal material only partially covering another material.

16. The method of claim 1, further comprising selecting the downhole structure to comprise an outer surface comprising the metal material and an inner surface free of the metal material.

17. The method of claim 1, further comprising selecting the metal material to consist of AISI 4130M7 alloy steel, AISI 4145H alloy steel, AISI 4715 alloy steel, AISI 8620 alloy steel, AISI 8630 alloy steel, SAE P555 alloy steel, P550 alloy steel, P650 alloy steel, or P750 alloy steel.

18. The method of claim 1, wherein applying electrical current to the downhole structure comprises applying a current density less than 200 $mA/cm^2$ and greater than or equal to 100 $mA/cm^2$.

* * * * *